US005105394A

United States Patent [19]

Percy

[11] Patent Number: 5,105,394

[45] Date of Patent: Apr. 14, 1992

[54] CONSTRAINED DIAPHRAGM TRANSDUCER

[75] Inventor: Joseph L. Percy, San Diego, Calif.

[73] Assignee: United States of America as represented by the Secretary of the Navy, Washington, D.C.

[21] Appl. No.: 227,976

[22] Filed: Jul. 29, 1988

[51] Int. Cl.[5] ..... H04R 15/00

[52] U.S. Cl. ..... 367/174; 181/149; 181/173; 181/402

[58] Field of Search ..... 181/142, 400, 402, 149, 181/158, 161, 166, 170, 173, 242; 367/174, 175, 176, 188, 132; 381/189

[56] References Cited

U.S. PATENT DOCUMENTS

| | | | |
|---|---|---|---|
| 2,623,957 | 12/1952 | Cragg et al. | 181/242 |
| 2,758,203 | 8/1956 | Harris | 250/17 |
| 3,000,216 | 9/1961 | Peters et al. | 73/398 |
| 3,126,559 | 3/1964 | Alexander | 9/10 |
| 3,262,093 | 7/1966 | Junger et al. | 340/10 |
| 3,345,607 | 10/1967 | Nelkin et al. | 340/8 |
| 3,436,776 | 4/1969 | Davis | 9/8 |
| 3,567,562 | 3/1971 | Gordon et al. | 161/7 |
| 3,721,311 | 3/1973 | Mott-Smith | 367/146 |
| 3,789,166 | 1/1974 | Sebesta | 381/189 X |
| 3,854,116 | 12/1974 | Toulis et al. | 340/8 L |
| 4,034,693 | 7/1977 | Challenger | 114/16 E |
| 4,123,622 | 10/1978 | Macleod | 181/149 X |
| 4,183,422 | 1/1980 | Williams | 181/173 |
| 4,384,351 | 5/1983 | Pagliarini, Jr. et al. | 367/175 |
| 4,420,826 | 12/1983 | Marshal, Jr. et al. | 367/167 |
| 4,507,093 | 3/1985 | Norvell | 441/2 |
| 4,524,693 | 6/1985 | McMahon et al. | 367/167 |
| 4,541,079 | 9/1985 | Thipen | 367/19 |
| 4,600,077 | 7/1986 | Drever | 181/158 |
| 4,700,333 | 10/1987 | Massa et al. | 367/188 X |
| 4,782,470 | 11/1988 | Poturnicki et al. | 367/157 |

*Primary Examiner*—Brian S. Steinberger

*Attorney, Agent, or Firm*—Harvey Fendelman; Thomas G. Keough; Peter A. Lipovsky

[57] ABSTRACT

An acoustic source apparatus has a loudspeaker enclosed within a substantially pressure resistant and water tight enclosure. Acoustic energy from the loudspeaker emanates through an opening in the enclosure. This opening is covered by a resilient diaphragm that transmits the acoustic energy to an aqueous medium. A net constrains the diaphragm to a preselected size and shape. The net further impedes overexpansion of the diaphragm and restrains the diaphragm from migrating due to buoyancy. Additonally, the net stiffens and strengthens the diaphragm, to thereby increase the resonant frequency, impedance and quality factor of the transducer system and decrease the transmission bandwidth of the system. Constraining the transducer diaphragm with the net makes higher transducer source levels possible.

8 Claims, 1 Drawing Sheet

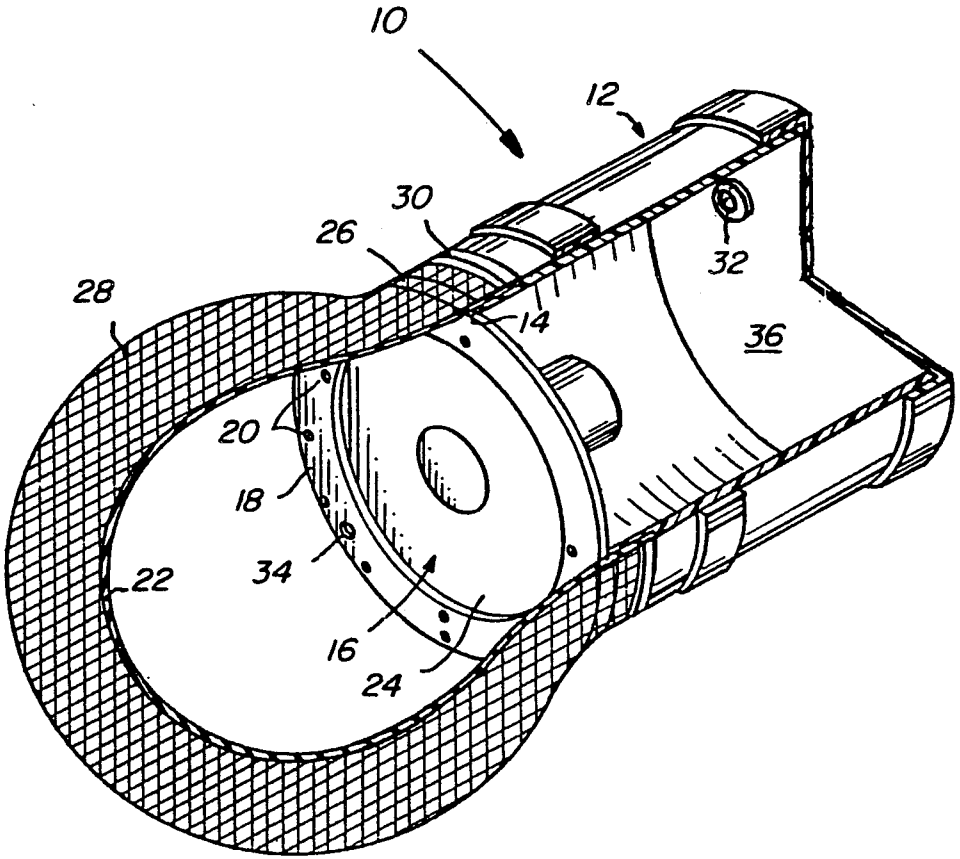
10
12
14
16
18
20
22
24
26
28
30
32
34
36

CONSTRAINED DIAPHRAGM TRANSDUCER

STATEMENT OF GOVERNMENT INTEREST

The invention described herein may be manufactured and used by or for the government of the United States of America for governmental purposes without the payment of any royalties thereon or therefor.

CROSS-REFERENCE TO RELATED APPLICATION

This application is related to the co-pending application Ser. No. 07/227,937 titled "Pressure Compensated Transducer System with Constrained Diaphragm" filed July 29, 1988 by Joseph L. Percy.

BACKGROUND OF THE INVENTION

1. Field of the Invention

The invention relates generally to the field of electrical communications. More specifically, the invention relates to acoustic wave systems and devices. In greater specificity, but without limitation thereto, the invention relates to an underwater signal transducer apparatus having an electrically driven, constrained diaphragm.

2. Description of the Related Art

Underwater communication is commonly made through acoustoelectric signal transducers. Typically, these transducers are acoustic loudspeakers housed within watertight and pressure resistant enclosures. Operation of these loudspeakers produces air perturbations within the transducer enclosure, which are in turn passed to a resilient membrane or diaphragm that covers an open part of the enclosure. The diaphragm serves to transmit these air perturbations to the underwater medium.

In the past, generally spherical diaphragms have been incorporated with some underwater signal transducers. These spherically configured diaphragms have been considered to be particularly desirable for sonar applications requiring axially symmetric wave front patterns. Yet, air-filled, spherically configured diaphragms have been known to migrate due to buoyancy, oftentimes rupturing in the process. Further, in cases in which the inflatable spherical diaphragm has been used, the inherent resiliency of this diaphragm has contributed to low resonant frequency, low impedance and low quality factor as well as a large bandwidth of the transducer system. Additionally, transducer systems utilizing this type of diaphragm have been known to have relatively low acoustic source levels, as transducer power requirements are high in relation to appreciable sound transmission.

SUMMARY OF THE INVENTION

The present invention is an underwater signal transducer apparatus having an electrically driven, constrained diaphragm. A loudspeaker, housed within an enclosure, has a front side enclosed by a resilient and expandable diaphragm. The diaphragm picks up pressure perturbations from the loudspeaker and transmits these perturbations to the ocean medium in the form of acoustic energy. A constraining net, attached to the transducer enclosure, surrounds a periphery of the diaphragm. The net peripherally constrains the diaphragm and impedes the diaphragm from migrating due to buoyancy. Additionally, the net serves to stiffen and strengthen the diaphragm thereby increasing the resonant frequency, impedance and quality factor of the transducer system while decreasing the transmission bandwidth of the system. By constraining the transducer diaphragm in accordance with the invention, higher transducer source levels are made possible.

Objects of the Invention

It is an object of the invention to provide an underwater signal transducer apparatus having a diaphragm capable of high acoustic source levels.

It is a further object of the invention to provide an underwater signal transducer apparatus having a diaphragm that is stiffened and strengthened to thereby increase the resonance frequency, impedance and quality factor of the transducer system while decreasing the bandwidth of the transducer system.

It is yet a further object of the invention to provide an underwater signal transducer apparatus having a diaphragm that is prevented from migrating due to buoyancy.

Still yet a further object of the invention is to provide an underwater signal transducer apparatus having a diaphragm that is peripherally constrained.

Other objects and many of the attendant advantages of this invention will become readily appreciated as the same becomes better understood by reference to the following detailed description when considered in conjunction with the accompanying drawing.

BRIEF DESCRIPTION OF THE DRAWING

The FIGURE is an isometric view sectioned to show detail of the invention.

DESCRIPTION OF THE PREFERRED EMBODIMENT

Referring to the FIGURE there is shown an isometric view, partially sectioned, of a signal transducer apparatus 10 of the present invention. Apparatus 10 includes a substantially pressure resistant and watertight enclosure 12.

Housed within enclosure 12, at an open end 14 thereof, is an acoustic transducer 16, such as a conventional electromagnetic loudspeaker. Loudspeaker 16 is mounted to open end 14 of the enclosure by way of a flange 18 and conventional fasteners 20.

A resilient, inflatable and watertight diaphragm 22 covers a front side 24 of transducer 16 and is placed over open end 14 of enclosure 12. Diaphragm 22 is sealed to open end 14 of the enclosure by means such as a conventional hose clamp 26. The diaphragm is typically a balloon, such as is available through commercial sources.

A net 28 is used to constrain diaphragm 22. Net 28 is securely fastened to enclosure 12 by any suitable means such as a conventional cable tie 30.

In operation, compressed gas is fed into enclosure 12 through a conventional gas valve 32 that is sealingly attached to the enclosure. The gas inflates diaphragm 22 by passing from the enclosure to the diaphragm through a vent 34 in transducer flange 18.

Vent 34 is dimensioned to permit the free flow of gas between enclosure 12 and diaphragm 22 and to substantially prevent acoustic coupling between the diaphragm (front) side of loudspeaker 16 and the enclosure (back) side of the loudspeaker. For example, a prototype of the invention includes a vent hole of about three-sixteenths inches in diameter for a ten inch diameter enclosure in which a six and one-half inch diameter loudspeaker is housed.

Net 28 is contiguous to a periphery of diaphragm 22 to peripherally constrains the diaphragm to a preselected size and shape. Further, net 28 impedes overexpansion of the diaphragm and restrains the diaphragm from migrating due to buoyancy. Additionally, net 28 increases the stiffness and strength of the diaphragm, thereby increasing the resonant frequency, impedance and quality factor of the transducer system while decreasing the transmission bandwidth of the transducer apparatus. By constraining the diaphragm as illustrated in the FIGURE, higher transducer source levels were made possible, as compared to a transducer system not having a diaphragm constrained in this manner. It should be noted that net 28 must not have meshes so constraining as to prevent appreciable vibration of the diaphragm.

For example, a 10 inch diameter generally spherical diaphragm inflated within a net constructed so as to have an extended shape of about 13 inches in diameter was found to vibrate well when constrained by generally diamond shaped meshes of roughly one-quarter by three-eighths of an inch. Of course, these dimensions are given by way of example and are not intended to limit the scope of the invention.

Additionally, nets made of synthetics such as "Nylon" proved to perform superiorly to nets made of natural materials such as cotton. The nets made of natural materials had generally lesser strength than those of the synthetics and were found to stretch less predictably when wet.

Though the invention has been disclosed as incorporating an inflatable, generally spherical diaphragm, it must be noted that other types of diaphragms, including non-inflatable as well as generally flat shaped and arc shaped diaphragms, for example, may be incorporated with the invention in a manner like that as has been illustrated. Additionally, constraining nets of other than a generally spherical shape may be used with the invention to peripherally constrain an enclosed diaphragm to other than a spherical shape.

Further, the transducer apparatus of the invention may be energized and driven by suitable electronic equipment made a part of the apparatus. This could be, for example, disposed within a cylindrical compartment 36 defined by enclosure 12. Alternatively, the apparatus could be energized and driven from a remote source.

Obviously, those skilled in the art will realize that these and other modifications and variations of the invention are possible in light of the above teachings. Therefore, it is to be understood that within the scope of the following claims the invention may be practiced otherwise than as specifically described.

What is claimed is:

1. In an apparatus for propagating acoustic energy through water and of the type having a transducer for converting electrical energy into acoustic energy an a resilient diaphragm disposed between said transducer and said water for transmitting acoustic energy from said transducer to said water, the combination wherein the improvement comprises:

a net contiguous to a periphery of said diaphragm and being of a preselected shape and size to shape and dimensionally constrain said diaphragm, said net further for strengthening and stiffening said diaphragm, said net defining meshes therein for the passage of acoustic energy therethrough.

2. The apparatus of claim 1 in which said net has a generally spherical shape at extension.

3. The apparatus of claim 2 in which said diaphragm is inflated with a compressed gas.

4. An apparatus for propagating acoustic energy through an aqueous medium comprising:

transducer means for converting electrical energy into acoustic energy;

enclosure and protecting means for enclosing said transducer means and for protecting said transducer means from the effects of said aqueous medium, said enclosure and protecting means having an open end through which said acoustic energy travels;

a resilient diaphragm covering and sealing said open end of said enclosure and protecting means for transmitting acoustic energy from said transducer means to said aqueous medium; and a net for peripherally constraining, strengthening and stiffening said diaphragm, said net being contiguous to a periphery of said diaphragm with said net defining meshes therein for passage of acoustic energy therethrough.

5. The apparatus of claim 4 in which said diaphragm is inflatable and in which said net has a generally spherical shape at extension.

6. In an apparatus for propagating acoustic energy through an aqueous medium, said apparatus being of the type having an transducer for converting electrical energy into acoustic energy and a resilient diaphragm disposed between said transducer and said aqueous medium for transmitting acoustic energy from said transducer to said aqueous medium, the combination wherein the improvement comprises:

a net for peripherally constraining said diaphragm, for strengthening said diaphragm and for stiffening said diaphragm, said net being contiguous to a periphery of said diaphragm with said net defining meshes therein for passage of acoustic energy therethrough.

7. The apparatus of claim 6 in which said net has a generally spherical shape at extension.

8. The apparatus of claim 7 in which said diaphragm is inflated with a compressed gas.

* * * * *